US008115100B2

(12) United States Patent
Peckham

(10) Patent No.: US 8,115,100 B2
(45) Date of Patent: Feb. 14, 2012

(54) ELECTRICAL AND DATA OUTLET DECOMMISSIONING ARRANGEMENT

(76) Inventor: Albert E. Peckham, Gloucester, MA (US)

( * ) Notice: Subject to any disclaimer, the term of this patent is extended or adjusted under 35 U.S.C. 154(b) by 324 days.

(21) Appl. No.: 12/586,524

(22) Filed: Sep. 23, 2009

(65) Prior Publication Data

US 2011/0067897 A1 Mar. 24, 2011

(51) Int. Cl.
*H01R 13/44* (2006.01)

(52) U.S. Cl. ..... 174/67; 174/66; 439/135

(58) Field of Classification Search ..... 174/66, 174/67; 220/241, 242; 439/136, 142, 147, 439/135; D8/353; D13/177
See application file for complete search history.

(56) References Cited

U.S. PATENT DOCUMENTS 4,603,932 A * 8/1986 Heverly ..... 439/147
6,765,149 B1 * 7/2004 Ku ..... 174/66
7,795,534 B2 * 9/2010 Lin et al. ..... 174/66

* cited by examiner

*Primary Examiner* — Dhiru R Patel
(74) *Attorney, Agent, or Firm* — Don Halgren

(57) ABSTRACT

A temporary electrical or data outlet decommissioning arrangement includes: a generally rectangularly shaped receiving baseplate; a cover plate having a plurality of receiving baseplate engagement tabs thereon, wherein the baseplate has two side walls and two transverse end walls defining a cover plate receiving opening, the side walls each have a common plurality of tab-receiving slots therein, and wherein the cover plate has two side walls and two transverse end walls, wherein the cover plate has a pair of engagement tabs extending off of one side wall, and has a single locking tab on the side opposite the pair of engagement tabs, and the single locking tab has an adjacent recessed support wall to provide a recess in the side wall of the cover plate to permit a tool access for removal of the cover plate from the baseplate.

8 Claims, 5 Drawing Sheets

ELECTRICAL AND DATA OUTLET DECOMMISSIONING ARRANGEMENT

BACKGROUND OF THE INVENTION

1. Field of the Invention

This invention relates to electrical or data outlets and particularly to secure cover plate arrangements to minimize misuse of outlets.

2. Prior Art

Electrical outlets may be dangerous to small children when access to those electrical outlets is left available to them. Those electrical outlets may also often be available for use by the general public for the operation of their personal communication devices, laptops and various other electrical equipment. The property owner where these electrical outlets may be arranged may not wish to have these electrical outlets available for use by just anyone, such as small children, travelers or people just looking for free electricity.

In many public places, electrical and/or data outlets are merely taped over rather than being electrically disconnected, removed and blanked off, probably to avoid the time and cost of an electrician and the possible future need to restore functionality to the box.

My earlier U.S. Pat. No. 4,851,612, issued on 25 Jul. 1989, incorporated herein by reference, disclosed an outlet protector, which showed an enclosure attachable to an electrical outlet cover plate, to provide a safety enclosure for plugs mated to outlets within the cover plate.

It is an object of the present invention to provide an electrical/data outlet cover plate arrangement which will temporarily decommission an electrical/data outlet.

It is another object of the present invention to provide an electrical/data outlet decommissioning arrangement which is utilizable without the services of an expensive electrician.

It is a further object of the present invention to permit a decommissioning cover plate to be attached to the holes in the electrical/data outlet receptacle rather than the electrical box as is the case with a standard blanking plate, thereby allowing for the receptacle to remain installed while it is decommissioned.

It is a further object of the present invention to provide a space between the decommissioning cover plate and the baseplate so as to allow for protrusion of the intact electrical receptacle or data port that is being covered/decommissioned.

It is yet a further object of the present invention to provide an electrical/data outlet decommissioning arrangement which allows for the outlet to be restored to its regular use quickly and without electrical alterations.

It is yet still a further object of the present invention to provide a cover plate which is removably attachable from a receiving baseplate by a simple tool, yet not readily removable by unauthorized users.

It is another object of the present invention to provide a cover plate which is securable to a receiving baseplate which permits two sided engagement therewith.

Is yet still a further object of the present invention to provide a cover plate which when secured to a receiving base plate at least partially covers the opening(s) through which the baseplate is secured to the electrical/data outlet.

It is yet another object of the present invention to provide a decommissioning plate which when secured to a receiving base plate does not allow for a grasping area suitable to a human hand, thus preventing casual removal of that decommissioning plate.

BRIEF SUMMARY OF THE INVENTION

The present invention relates to an electrical or data outlet box temporary decommissioning arrangement comprising a receiving baseplate and a removably attachable locking decommissioning cover plate. The electrical or data outlet box is typically secured within an opening in a wall. The typical electrical outlet box cover plate has a pair of spaced apart openings, or a single rectangular opening to allow for decorative or "GFI" type receptacles. Data outlets may also have other opening configurations.

With the present invention, the typical cover plate is removed from the front of the electrical or data outlet box. The replacement baseplate is then attached to the front surface of the electrical outlet by one or more threaded members which extend through the baseplate and into threaded openings in the electrical outlet.

The receiving baseplate is preferably a generally rectangular unit having a pair of transverse ends and a pair of opposed parallel side portions. An inner peripheral surface extends inwardly from the transverse ends and the pair of opposed parallel side portions to define an internal rectangle or opening therein. The side walls have an inner perimeter wall. An engagement tab receiving slot is arranged at each end of the inner perimeter wall of the side walls. A locking tab receiving slot is arranged at the midpoint of each side wall between the engagement tab recess slots at each end thereof. One or more member openings are arranged either in the central area or at each end of the transverse wall extending partially through that transverse wall and completely through the inner peripheral surface thereat. The member openings are for receipt of a threaded screw that attaches the baseplate to the electrical or data outlet receptacle.

The decommissioning cover plate is sized so as to be readily disposed within the opening defined by the transverse walls and the inner perimeter walls of the side walls of the receiving baseplate. The cover plate has a pair of elongated parallel side members and a pair of parallel transverse end members. An engagement tab extends off of each end of only one side wall, and a single locking tab extends outwardly from a mid-point of the opposite side wall. The engagement tabs at each end of one side wall are arranged to be received in corresponding engagement tab recess slots in one of the two inner perimeter walls of the side wall of the receiving baseplate. The locking tab is arranged to be flexibly inserted into and withdrawn from the particular locking tab receiving slot at the midpoint of the inner perimeter wall of the receiving baseplate opposed to the side wall in which the engagement tabs are inserted.

The locking tab on the side wall of the locking decommissioning cover plate has a molded recess thereadjacent. The molded recess permits a tool to be inserted between the inner perimeter wall and the flex wall of the cover plate so as to bias the locking tab inwardly away from the locking tab receiving slot to permit the pried, pivotal, "skilled" removal of that cover plate and hence authorized access to the electrical and/or data outlets therewithin.

The locking tab has a distal lower end portion with a radius of curvature thereon, to permit the locking tab to slide and deflect against the upper edge of the inner perimeter wall of the receiving baseplate using simple hand pressure and to hence slip into the locking tab receiving slot without the use of a tool. For removal of the decommissioning plate, a tool, such as a screwdriver, may be inserted into the recess between the cover plate and the inner perimeter wall at the locking tab receiving slot, to flex the locking tab inwardly and hence permit the decommissioning cover plate to be pivoted about its engagement tabs on its opposite side thereon for removal of that decommissioning cover plate from the receiving baseplate.

The invention thus comprises a temporary electrical or data outlet decommissioning arrangement comprising: a generally rectangularly shaped receiving baseplate for exchange with a cover plate on an electrical or data outlet box; a decommissioning cover plate having a plurality of receiving baseplate engagement tabs thereon, wherein the baseplate has two side walls and two transverse end walls defining a cover plate receiving opening, the baseplate having one or more openings for receipt of threaded securement members through the baseplate and into the threaded opening(s) in the electrical/data outlet receptacle normally utilized for securement of the standard type of cover plate, and wherein the baseplate has side walls which each have a common plurality of tab-receiving slots therein, and wherein the decommissioning cover plate has two side walls and two transverse end walls, defining the shape of the decommissioning cover plate to mate with the decommissioning cover plate receiving opening, wherein the decommissioning cover plate has a pair of engagement tabs extending off of one side wall, and has a single locking tab on the more flexible mid-point side wall opposite the pair of engagement tabs, the single locking tab having a radius of curvature for slidable, flexed, hand pressured insertion of the decommissioning cover plate into locking engagement with the baseplate, wherein the decommissioning cover plate also covers up any securement members passing through the member receiving openings in the baseplate; and wherein the single locking tab has an adjacent recessed support wall to provide a recess in the side wall of the cover plate to permit a tool access for removal of the cover plate from the baseplate.

The invention also comprises a temporary electrical or data outlet decommissioning arrangement comprising: a generally rectangularly (or square) shaped receiving baseplate for exchange with a similarly shaped cover plate on an electrical or data outlet box; a decommissioning cover plate having a plurality of baseplate receiving engagement tabs thereon, wherein the baseplate has two side walls and two transverse end walls defining a cover plate receiving opening, and wherein the baseplate has side walls which each have a common plurality of tab-receiving slots therein, and wherein the decommissioning cover plate has two side walls and two transverse end walls, defining the shape of the decommissioning cover plate to mate with the decommissioning cover plate receiving opening, wherein the decommissioning cover plate has a pair of engagement tabs extending off of one side wall, and has a single locking tab on the more flexible mid-point side wall opposite the pair of engagement tabs; and wherein the single locking tab has an adjacent recessed support wall to provide a recess in the side wall of the cover plate to permit a tool access for removal of the cover plate from the baseplate. The baseplate has one or more openings for receipt of threaded securement members through the baseplate and into the threaded openings in the electrical/data receptacle normally utilized for securement of standard cover plates to the electrical/data receptacle. The single locking tab has a radius of curvature for slidable, flexed, hand pressured insertion of the decommissioning cover plate into locking engagement with the baseplate. The decommissioning cover plate covers up any securement members received through the member receiving openings in the baseplate.

The invention also comprises a method to temporarily decommission an electrical or data outlet box, comprising one or more of the following steps, including: exchanging a typical cover plate for a generally rectilinearly shaped receiving baseplate on the electrical or data outlet box, wherein the baseplate has two side walls and two transverse end walls defining a decommissioning cover plate receiving opening, the baseplate having one or more openings for receipt of threaded securement members through the baseplate and into the threaded openings in the electrical receptacle normally utilized for securement of a standard cover plate, and wherein the baseplate has side walls which each have a common plurality of tab-receiving slots therein, and wherein the decommissioning cover plate has two side walls and two transverse end walls, defining the shape of the decommissioning cover plate to mate with the decommissioning cover plate receiving opening; forming a pair of engagement tabs extending off of one side wall, and a single locking tab on the more flexible mid-point side wall opposite the pair of engagement tabs in the decommissioning plate, wherein the single locking tab has a radius of curvature; sliding and flexibly inserting the decommissioning cover plate into locking engagement with the baseplate, wherein the decommissioning cover plate also covers up any securement members received through the openings in the base-plate; forming a recess adjacent the single locking tab in the side support wall to permit a tool access for flexible, biased removal of the locking tab from the locking tab receiving slot and hence pivotal removal of the decommissioning cover plate from the baseplate.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
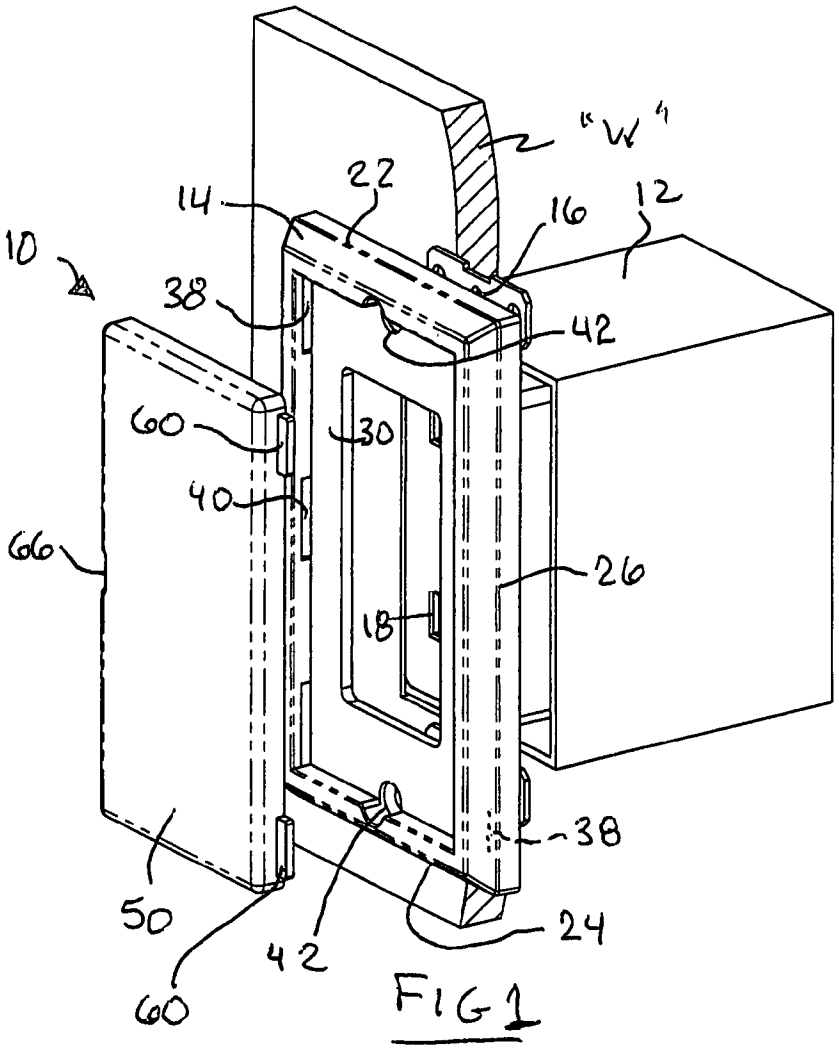
FIG. 1 is an exploded perspective view of an electrical or data outlet box shown arranged in a wall, with a receiving baseplate disposed thereadjacent and a locking cover plate also shown thereadjacent.
Figure 2:
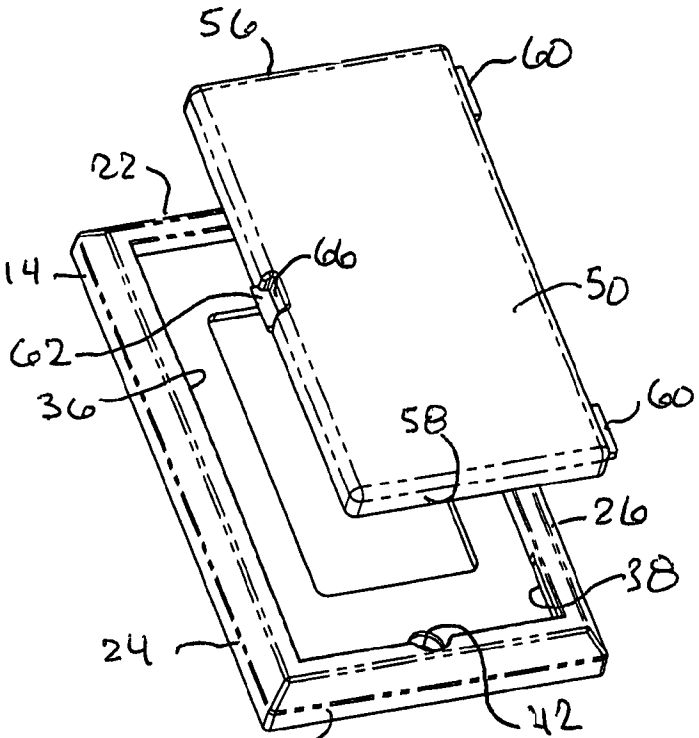
FIG. 2 is a perspective view of a receiving baseplate with a spaced apart locking cover plate, shown at a different angle than that shown in FIG. 1.
Figure 3:
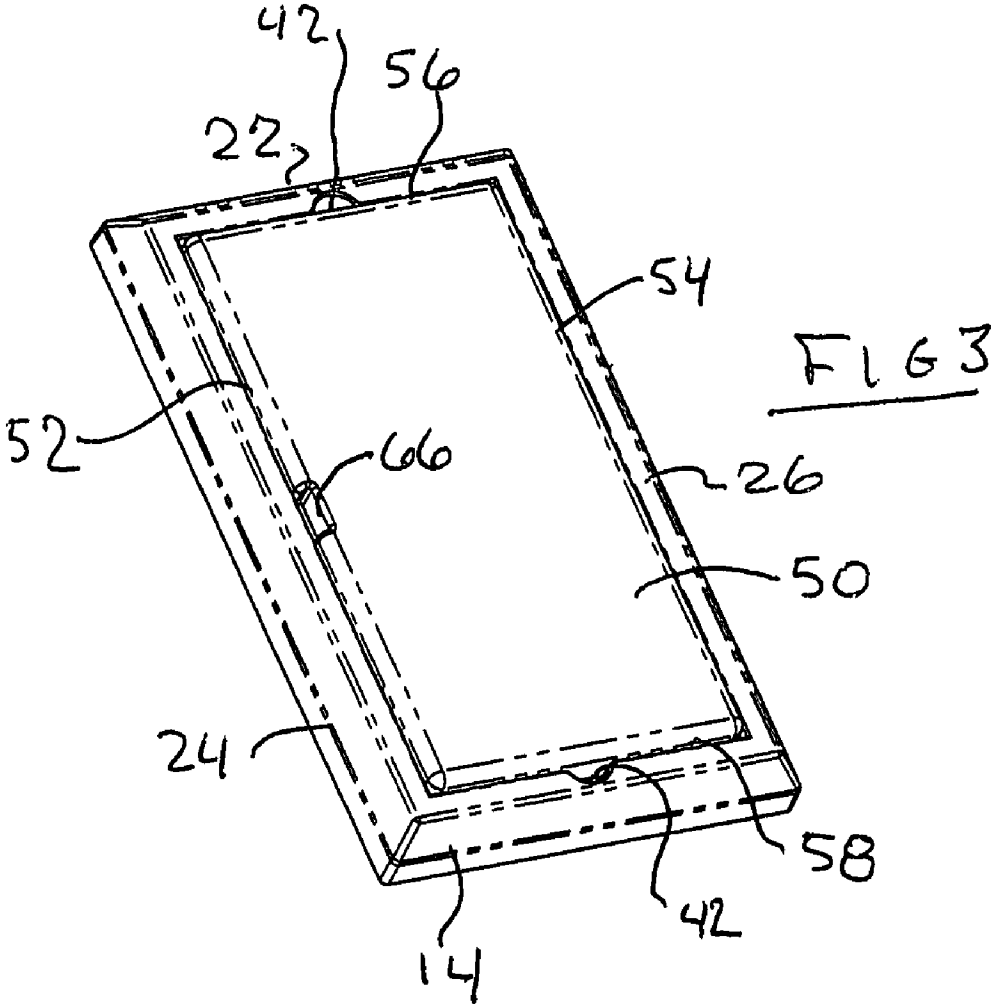
FIG. 3 is a perspective view of a receiving baseplate and a cover plate shown mated together.

Referring now to the drawings in detail, and particularly to FIG. 1 which shows the present invention which comprises a (temporary) electrical or data outlet decommissioning arrangement 10, wherein the typical cover plate (not shown for clarity) is removed from the front of an electrical outlet box 12 in a wall "W". A replacement receiving baseplate 14 is then attached to the front surface of the electrical outlet 18 by a pair of threaded members which extend through opposite ends of the receiving baseplate 14 and into threaded openings 16, at opposite ends of the electrical outlet 18.

The receiving baseplate 14 is a generally rectangular unit, as shown in FIGS. 1, 2, 3 and 6, having a pair of transverse ends 20 and 22, as well as a pair of opposed parallel first and second side portions 24 and 26. An inner peripheral surface 30 extends inwardly from the transverse ends 20 and 22 and the pair of opposed parallel side portions 24 and 26 to define an internal rectangular opening 32 therein. The side wall portions 24 and 26 have an inner perimeter wall 36. An engagement tab receiving slot 38 is arranged at each end of the inner perimeter wall 36 of the first and second side walls 24 and 26. A locking tab receiving opening or slot 40 is arranged at the midpoint of each side wall 24 and 26 between the engagement tab recess slots 38 at each end thereof. A member "end-located" non-threaded opening 42 is arranged at each end of the transverse wall 20 and 22 extending partially through that transverse wall 20 and 22, and completely through the inner peripheral surface 30 thereadjacent. The member opening 42 is for passage of a threaded screw or bolt (not shown for clarity) into the opening 42 which attaches and tightens the baseplate 14 to the electrical/data outlet 18.

Figure 4:
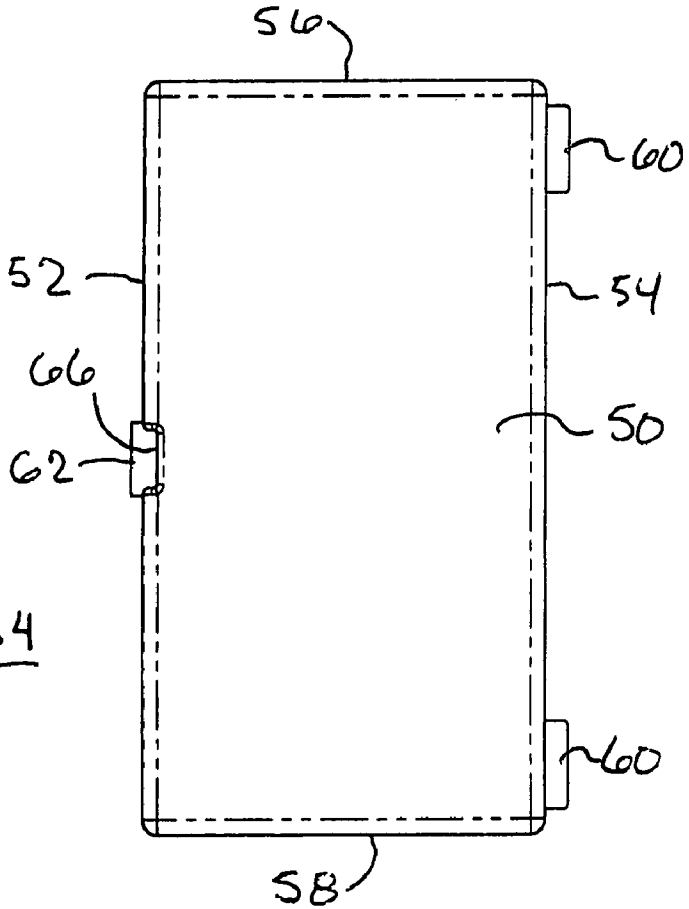
FIG. 4 is a plan view of a lockable cover plate.
Figure 5:
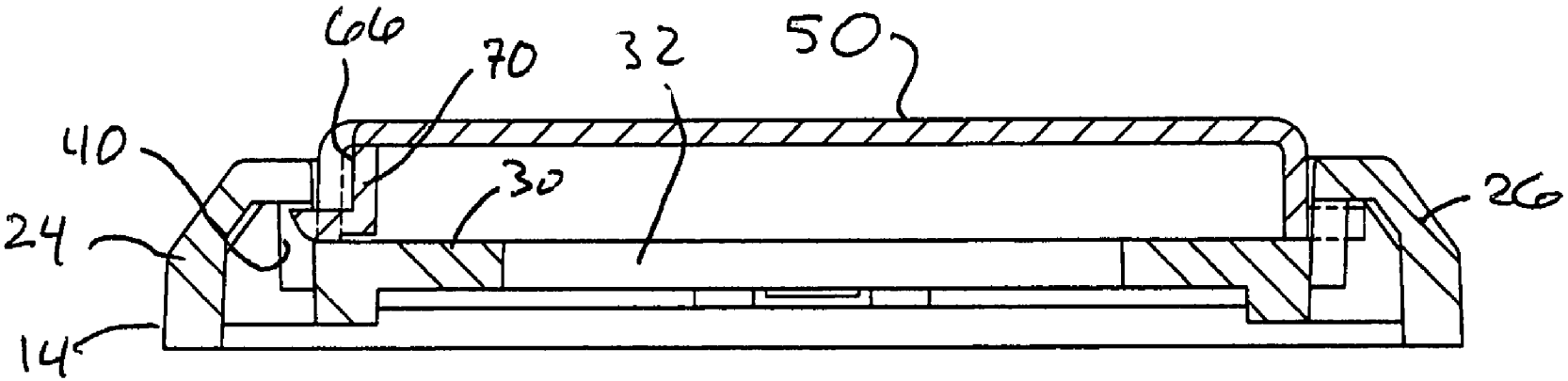
FIG. 5 is a view taken along the lines 5-5 of FIG. 4.
Figure 6:
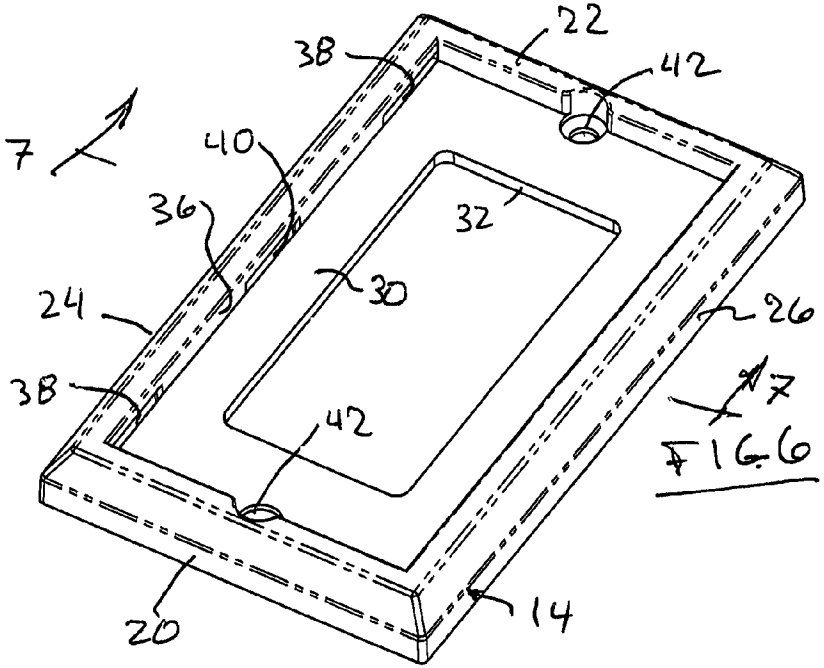
FIG. 6 is a perspective view of the receiving baseplate.
Figure 7:
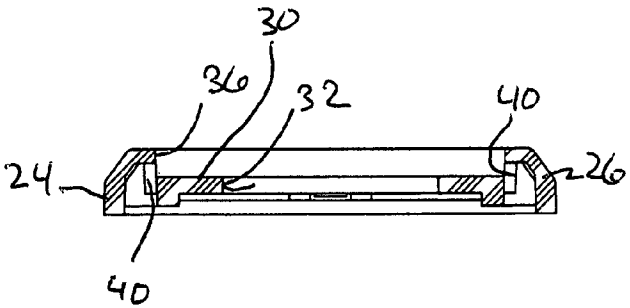
FIG. 7 is a view taken along the lines 7-7 of FIG. 6.

A cover plate 50 is sized so as to be disposed within (and withdrawn from) the opening defined by the transverse walls 20 and 22 and the inner perimeter walls 36 of the side walls 24 and 26 of the receiving baseplate 14. The cover plate 50 has a first side wall members 54 and a second side wall 52, parallel to one another, and a pair of parallel transverse end members 56 and 58. A rigid pivot point engagement tab 60 extends off of each end of the first side wall 54, and a single inwardly flexibly pivotable, articulable locking tab 62 extends outwardly from the opposite or second side wall 52, as best shown in FIG. 4. The engagement tabs 60 at each end of the first side wall 54 are arranged to be received in corresponding engagement tab recess slots 38 in either one of the two inner perimeter walls 36 of the side wall 26 of the receiving baseplate 14, as is evidenced in FIG. 3, the baseplate 14 being arranged to accommodate the cover plate 50 bi-directionately.

The locking tab 62 is arranged to be flexibly inserted into and withdrawn from the locking tab receiving slot 40 at the midpoint of the inner perimeter wall 36 of the receiving baseplate 14 opposed to the particular side wall 26 in which the engagement tabs 60 are inserted.

The locking tab 62 on the side wall 52 of the locking cover plate 50 has a molded recess 66 thereadjacent, as best seen in FIGS. 2, 3, 4 and 8. The molded recess 66 permits a tool (not shown for clarity) to be inserted between the inner perimeter wall 36 and the flex wall 70, as shown best in FIG. 8, adjacent the locking tab 62 of the cover plate 50, so as to be able to bias the locking tab 62 inwardly away from the receiving slot 40 to permit the removal of the cover plate 50 and hence access to the electrical outlets 18 therewithin.

Figure 8:
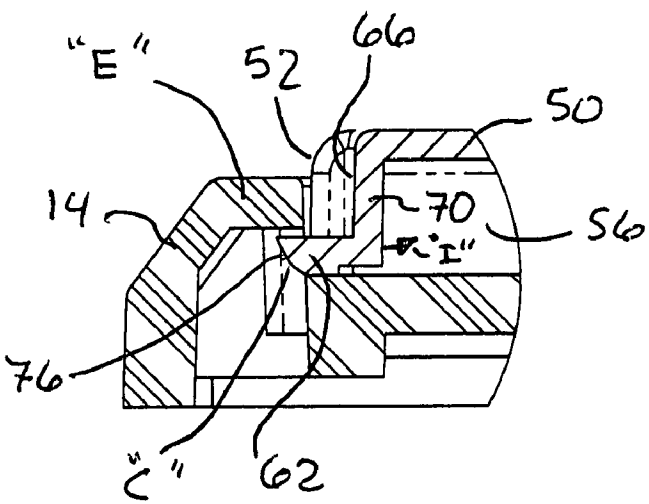
FIG. 8 is a sectional view of the cover plate and locking tab which is engaged in to the locking tab receiving slot on the receiving baseplate.

The locking tab 62 has a distal lower end portion 76 with a radius of curvature "C" on a lower distal edge thereof, as represented in sectional view in FIG. 8, to permit the locking tab 62 to slide against the upper edge "E" of the inner perimeter wall 36 of the receiving baseplate 14 using simple hand pressure and to hence slip into the locking tab receiving slot without the use of a tool.

For removal of the cover plate 50 however, a tool, such as a screwdriver, may be inserted into the recess 66 between the flex wall 70 of the cover plate 50 and the inner perimeter wall 36 at the locking tab receiving slot 40, to flex the locking tab 62 inwardly as shown by arrow "I", and hence permit the cover plate 50 to be pivoted about its engagement tabs 60 on its opposite side 54 thereon for removal of that cover plate 50 from the receiving baseplate 14, with a certain minimal tool and certain effort, yet with just enough requirements to make it difficult for a young or casual user to pry the cover plate 50 off of the baseplate 14.

The invention claimed is:

1. A temporary electrical or data outlet decommissioning arrangement comprising: a generally rectangularly shaped receiving baseplate for exchange with a cover plate on an electrical or data outlet box; a decommissioning cover plate for securement to the outlet box having a plurality of receiving baseplate engagement tabs thereon, wherein the baseplate has a first side wall and a second side wall and two transverse end walls defining a cover plate receiving opening, and wherein the baseplate has perimeter side walls which each have a common plurality of tab-receiving slots therein, and wherein the decommissioning cover plate has a first side wall and a second side wall and two parallel transverse end walls, wherein the decommissioning cover plate has a pair of engagement tabs extending from the first side wall, and has a single locking tab on a mid-point of the second side wall opposite the pair of engagement tabs; and wherein the single locking tab has an adjacent recessed support wall to provide a recess in the side wall of the cover plate to permit a tool access for removal of the cover plate from the baseplate.

2. The temporary electrical or data outlet decommissioning arrangement as recited in claim 1, wherein the baseplate has at least one opening for receipt of a threaded securement member through the baseplate and into a threaded opening in an electrical outlet normally utilized for securement of a standard cover plate to the electrical outlet.

3. The temporary electrical or data outlet decommissioning arrangement as recited in claim 1, wherein the single locking tab has a radius of curvature on a lower distal edge thereof, for slidable, flexed, hand pressured insertion of the decommissioning cover plate into locking engagement with the baseplate.

4. The temporary electrical or data outlet decommissioning arrangement as recited in claim 1, wherein the decommissioning cover plate covers up the securement member received through an opening in the baseplate.

5. The temporary decommissioning arrangement as recited in claim 1, wherein the baseplate has locking tab receiving openings on both the first side wall and the second side wall thereof, to permit orientation of the locking tab of the cover plate towards either side of the baseplate.

6. A method to temporarily decommission an electrical or data outlet box, comprising: exchanging a typical cover plate for a generally rectangularly shaped receiving baseplate on the electrical or data outlet box, wherein the baseplate has a parallel first and second side walls and two transverse end walls defining a decommissioning cover plate receiving opening, the baseplate having a pair of openings for receipt of threaded securement members through the baseplate and into the threaded openings in the electrical outlet normally utilized for securement of a standard cover plate to the electrical outlet, and wherein the baseplate has inner side walls which each have a common plurality of tab-receiving slots therein, and wherein the decommissioning cover plate has a first side wall and a second side wall and two transverse end walls; forming a pair of engagement tabs extending from the first side wall, and a single locking tab on a flexible mid-point of the second side wall opposite the pair of engagement tabs in the decommissioning plate, wherein the single locking tab has a radius of curvature on a lower distal edge thereof.

7. The method as recited in claim 6, including the step of: sliding and flexably inserting the decommissioning cover plate into locking engagement with the baseplate, wherein the decommissioning cover plate also covers up the securement members received through a pair of end-located openings in the baseplate.

8. The method as recited in claim 7, including the step of: forming a recess adjacent the single locking tab in the side support wall to permit a tool access for flexible, biased removal of the locking tab from one of the inner side walls locking tab receiving slot and hence pivotal removal of the decommissioning cover plate from the baseplate.

* * * * *